United States Patent [19]

Weber

[11] B 3,991,289

[45] Nov. 9, 1976

[54] AUTOMATIC TIMER

[75] Inventor: Richard H. Weber, Indianapolis, Ind.

[73] Assignee: P. R. Mallory & Co., Inc., Indianapolis, Ind.

[22] Filed: Aug. 5, 1974

[21] Appl. No.: 494,383

[44] Published under the second Trial Voluntary Protest Program on February 3, 1976 as document No. B 494,383.

[52] U.S. Cl. ..... 200/38 FA; 200/35 R

[51] Int. Cl.[2] ..... H01H 7/08; H01H 43/10

[58] Field of Search ..... 260/38 R, 38 A, 38 F, 260/38 FA, 38 FB, 35 R; 58/21.14, 21.16

[56] References Cited

UNITED STATES PATENTS 3,694,591 9/1972 Bassett et al. ..... 200/38 FA

*Primary Examiner*—Herman J. Hohauser

*Attorney, Agent, or Firm*—Hoffmann, Meyer & Hanson

[57] ABSTRACT

An automatic timer switch includes a time-of-day indicating means, a means for determining and indicating the cessation of a timed switching function, and a means for determining and indicating the duration of a timed switching function.

3 Claims, 8 Drawing Figures

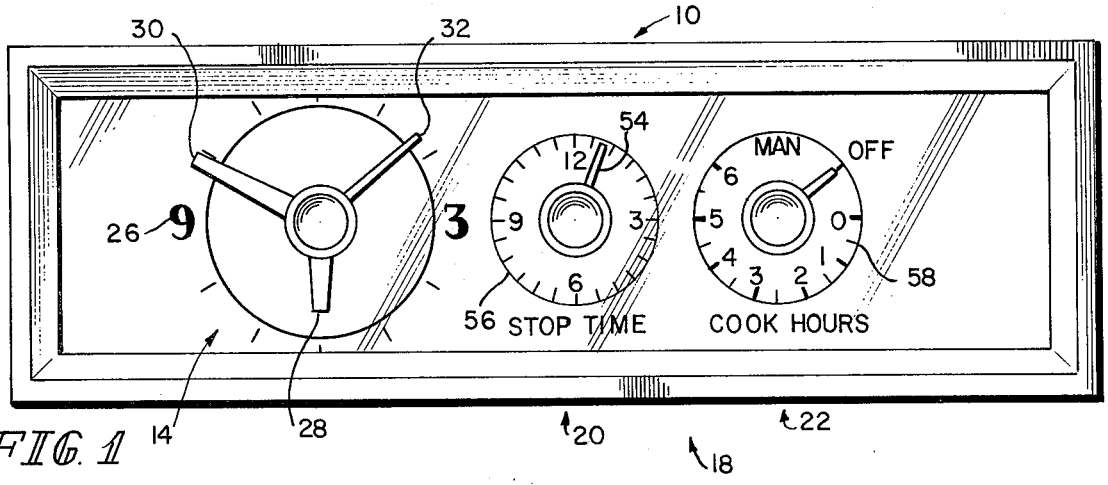
FIG. 1
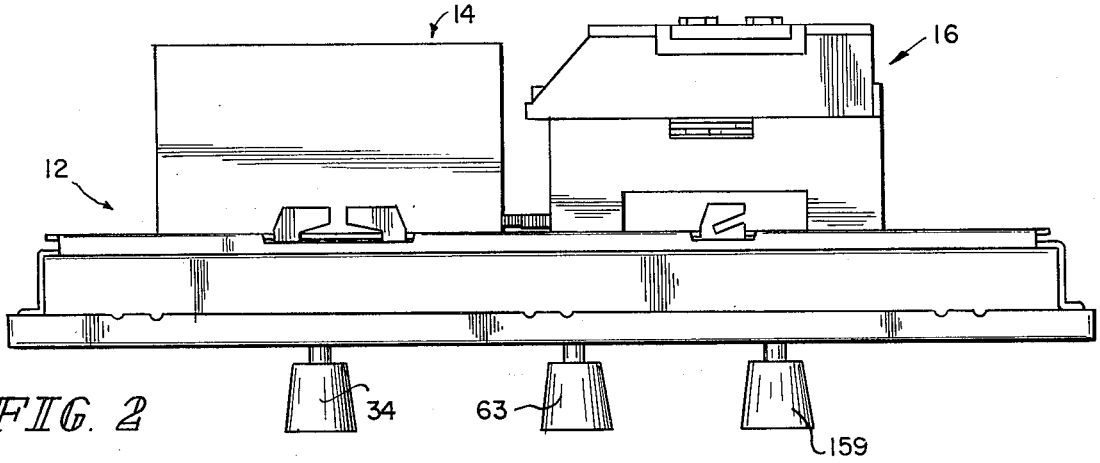
FIG. 2
FIG. 3A
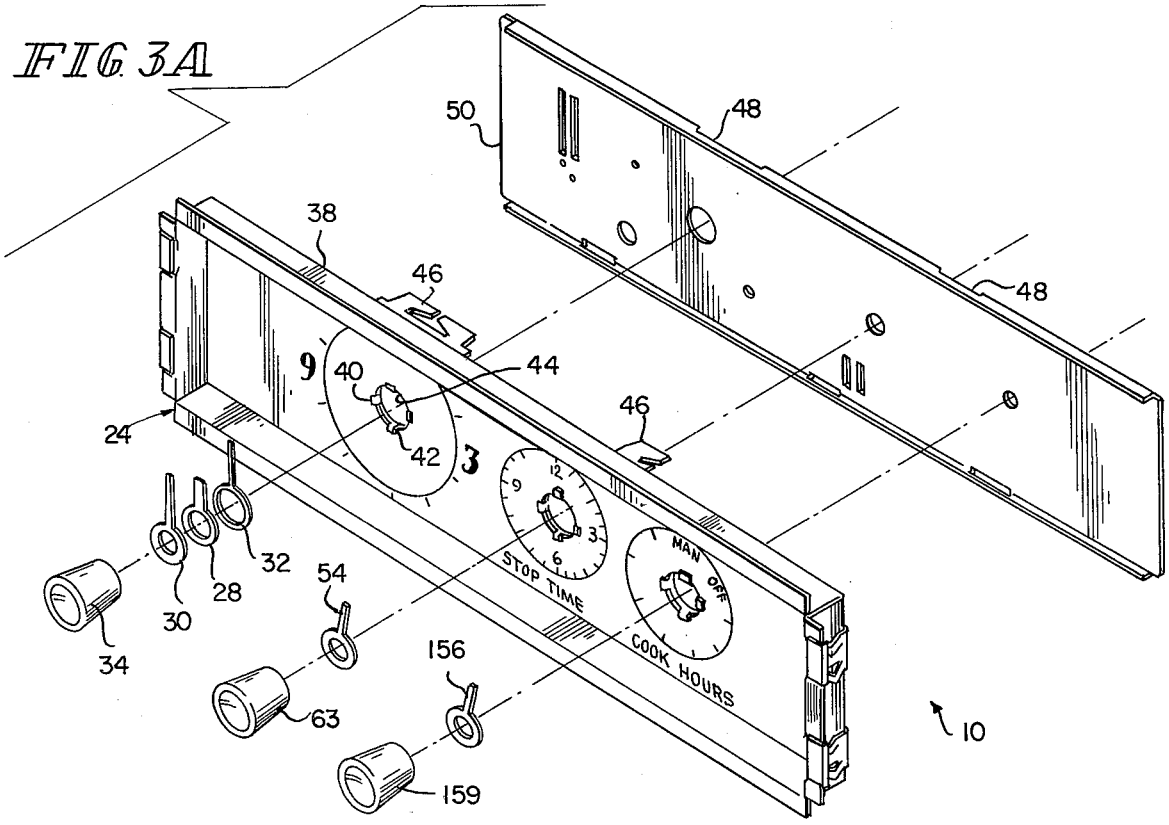

AUTOMATIC TIMER

Generally speaking the present invention relates to an automatic timer that includes a housing, a stop-time means rotatably carried in the housing for determining when a timed function is to be terminated, and a duration timing means rotatably carried in the housing for determining and indicating the duration of a timed function. A more specific example of the present invention is its utilization as a range timer capable of controlling the cooking time of an oven. The timing operation of the present invention is accomplished by manually setting a time that a timed function is to be terminated, then manually setting the desired duration of the timed function. In the example of a range timer, the first setting comprises a "stop-time" — the time-of-day the oven is to turn off, and the second setting comprises a "cook-hours" — the number of cooking hours desired. The present invention provides a greater degree of setting accuracy than many timers of this kind are now able to achieve, and at the same time this invention is reliable and easy to produce.

Accordingly, it is a feature of the present invention to provide a timer for timing a function, the length of timing and the termination of timing being manually settable. Another feature of the present invention is to provide a timer having a stop-time means rotatably carried in a housing, for determining when a timing function is to be terminated, that includes a timing gear and a stop-time set shaft. Another feature of the present invention is to provide a timer having a duration timing means, rotatably carried in a housing, for determining and indicating the duration of a timing function. Yet another feature of the present timer is to provide a timer having a geneva driver gear carried, by a clutch member and having an even number of gear teeth, the face width of every other tooth being less than the face width of the remaining teeth. Another feature of the present invention is to provide a timer including a timing cam member journalled in a housing and having projections in a circular pattern that are engaged by a geneva driver gear. Yet another feature of the present invention is to provide a timer with a switch actuation-means for selectively actuating an electrical switch.

These and other features will become more apparent from the specification taken in conjunction with the accompanying drawings wherein:

FIG. 1 is a front elevation view of an automatic timer switch;

FIG. 2 is a top view of the switch shown in FIG. 1;

Figure 3B:
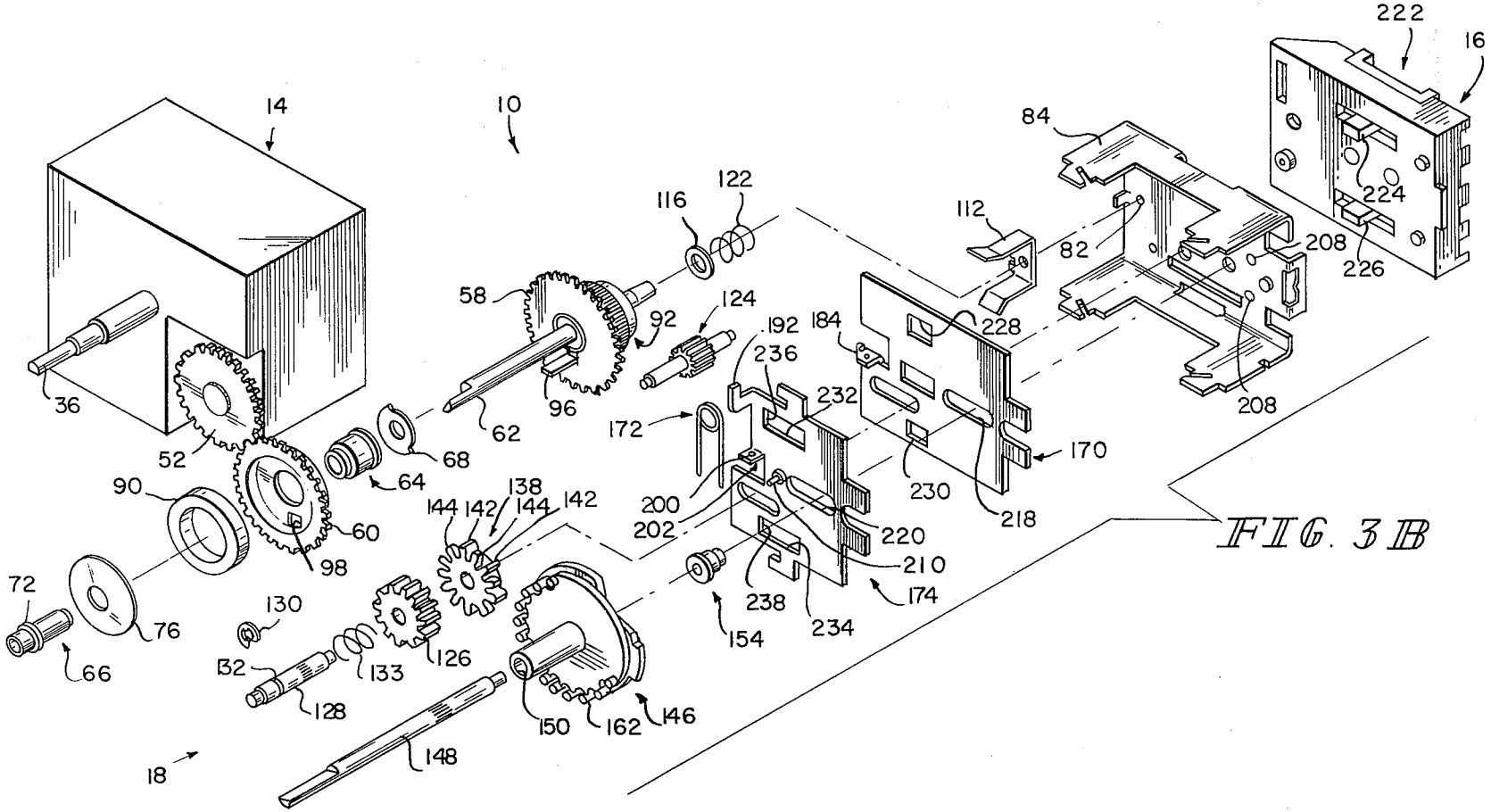

FIG. 3*a* is part of an exploded pictoral view of an automatic timer switch;

FIG. 3*b* is the remainder of the exploded pictoral view of the switch shown in FIG. 3*a;*

Figure 5:
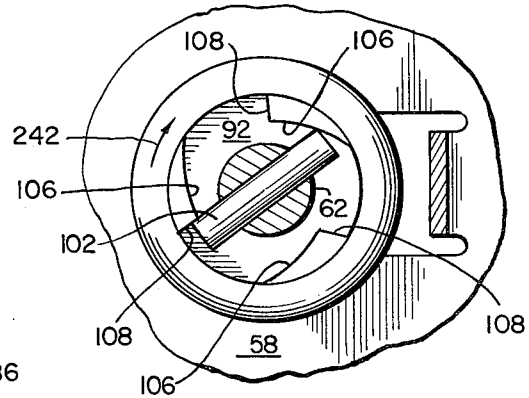
Figure 4:
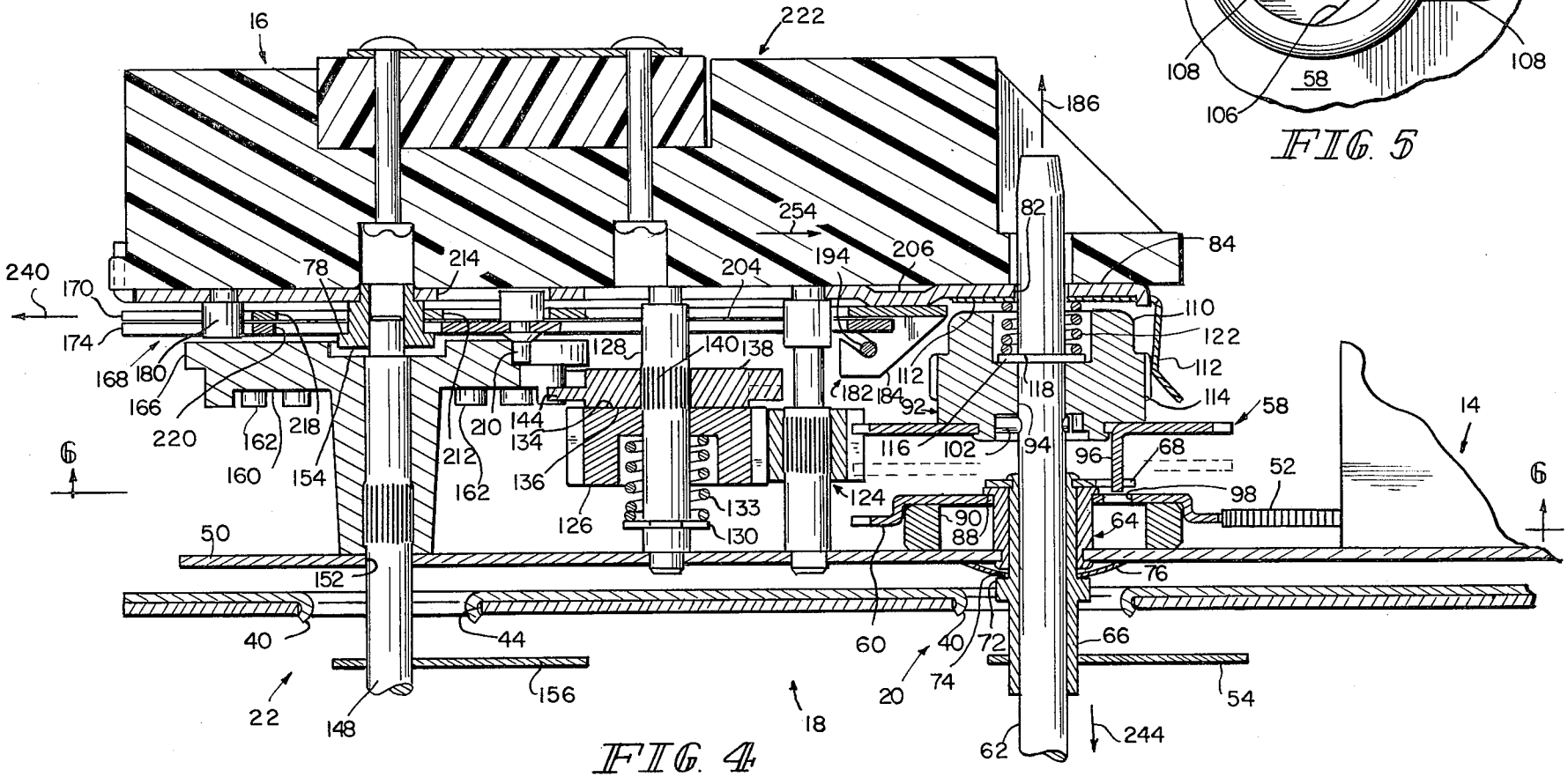
Figure 6:
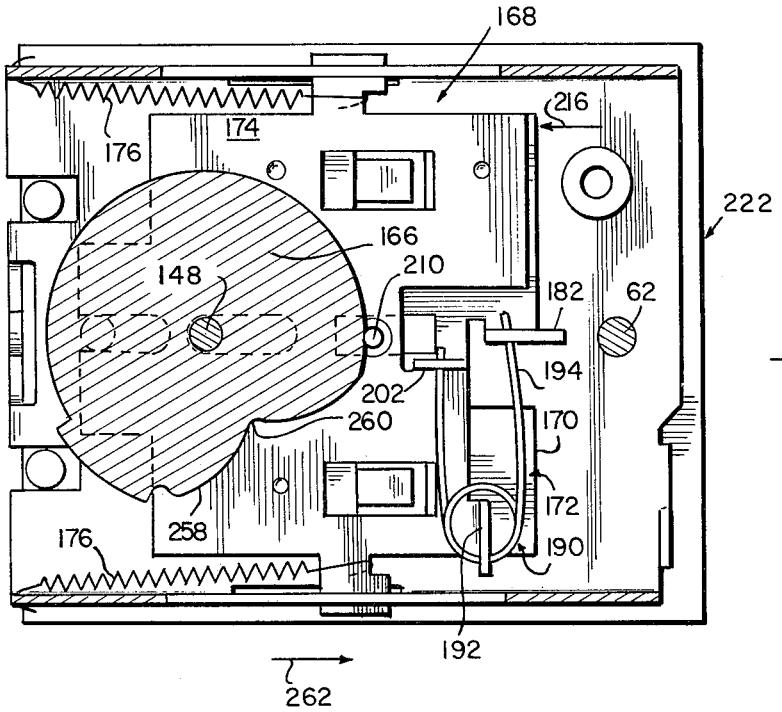

FIG. 4 is a partial sectional view of the automatic timer switch in FIGS. 1 through 3;

FIG. 5 is a partial view of a clutch portion of a timing hub shown in FIG. 4;

FIG. 6 is a sectional view taken along line 6—6 of FIG. 4; and

Figure 7:
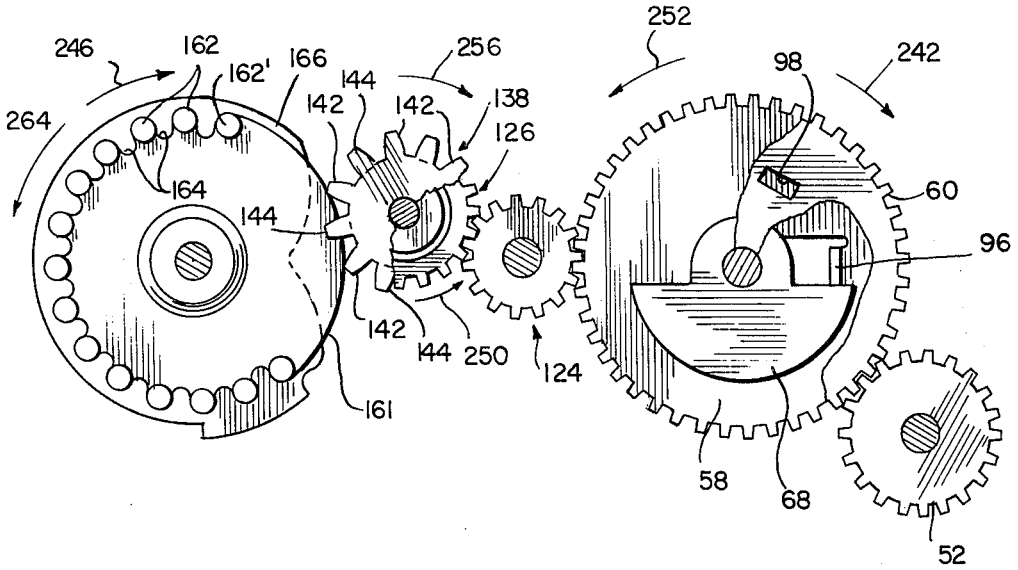

FIG. 7 is a diagramatic illustration of a portion of the rotational components of the automatic timer switch shown in the previous figures.

In FIGS. 1 and 3*a–b* the reference character 10 designates, generally, a motor driven timer 10 embodying this invention. Timer 10 generally comprises a housing 12, a time-of-day indicating means 14, an electrical switch 16, and a function timing means 18 that includes a stop-time means 20 and a duration timing means 22.

Housing 12 includes an elongated metallic dial plate 24 having time markings 26 imprinted thereon, and with respect to them an hour hand 28, a minute hand 30 and a second hand 32 are arranged to rotate. A knob 34, secured to the end of a clock set shaft 36 that projects through the plate 24, permits manual setting of time-of-day indicating means 14 of timer 10 to the correct time of day. Mounted on the rear side of the dial plate 24 is a metallic adapter plate 38. As shown in FIG. 4 tabs 40 extend forwardly from the adapter plate 38 through notches 42 in the dial plate 24 and around openings 44 therein for securing the adapter plate 38 to the dial plate 24. Tabs 40 are turned over to secure the adapter plate 38 in place. Four tabs 40 are employed at each location, only two being shown in FIG. 4.

Lugs 46, shown in FIG. 3*a*, extend rearwardly from the adapter plate 38 for entering openings 48 in a rectangular metallic mechanism plate 50 which is held in spaced relation to the rear side of the adapter plate 38.

Time-of-day indicating means 14 is illustrated herein as a clock displaying hours, minutes and seconds in a conventional manner against time markings 26. The clock is suitably connected, such as with screws, to housing 12. It should be understood that many different types of time-of-day indicating means may be used without departing from the spirit of the present invention. Function timing means 18 requires only a time-of-day input for its operation as a timer. In the illustrated embodiment this time-of-day input is imparted to stop-time means 20 from an output drive gear 52 running in synchronization with the hands 28, 30 and 32.

One type of time-of-day clock that can be used with function timing means 18 is described in detail in U.S. Pat. No. 3,601,973 issued Aug. 31, 1971 to R. M. Bassett and J. F. Gluth. This example also includes an interval timer in conjunction with the clock and an electrical switch, both features of which can be used with the present invention. The "start-time, cook-hours" timer portion of the Bassett-Gluth disclosure is replaced by the stop-time and duration timing means 20 and 22 of the present invention; and the result is an automatic timer as herein described.

An alternate form of motor driven timer 10, not illustrated, has no clock dial at all, but just a synchronous motor to inpart time-of-day information to stop-time means 20. In this example, prior to the setting of function timing means 18, a stop-time hand 54 carried by stop-time means 20 indicates the correct time-of-day against a stop-time dial 56 which has the same divisions and markings of a conventional 12-hour clock dial.

Another example of motor driven timer 10, not illustrated, includes a digital clock section for displaying the time-of-day. An output gear similar to gear 52 of the illustrated embodiment provides time-of-day input to stop-time means 20.

Referring now to FIGS. 3*b* and 4, stop-time means 20 includes a stop-time gear 58 and a timing gear 60 carried concentrically about a stop-time shaft 62. A stop-time knob 63 is pressed onto the end of shaft 62. A support bushing 64 is staked to mechanism plate 50, and a stop-time hand bushing 66 is rotatably carried in bushing 64. A drive dog 68 is staked to one end of bushing 66, and a stop-time hand 54 is press-fitted to the other end. An annular projection 72 on bushing 64 includes a shoulder 74 against which a bushing positioning spring 76 nests. The other end of spring 76 presses against a face of mechanism plate 50. Shaft 62 is journalled for concentric rotation within bushing 66. A distal end of shaft 62 is rotatably journalled in an aperture 82 in a metallic frame plate 84. Stop-time hand 54 is pressed onto shaft 62 and displays on a stop-time dial 56 the time-of-day that a timed switching function is to terminated.

Timing gear 60 is entrapped between a shoulder 88 of support bushing 64 and a spacer 90. Stop-time gear 58 is ridgedly staked to a hub member 92 which includes a central aperture 94 through which shaft 62 is free to rotate. Projecting from stop-time gear 58 is a leg 96 that can engage drive dog 68 and insert into an aperture 98 in timing gear 60. FIG. 5 shows a clutch profile disposed in a face of hub member 92 and a floating pin 102 carried freely in a hole through shaft 62. A clutch profile 100 includes a plurality of ramped surfaces 106 and engagement steps 108 which are engaged by pin 102 upon rotation of shaft 62 with respect to hub member 92. Hub member 92 further includes a rounded annular shoulder 110 near one end. A drag brake member 112 is fixedly carried by frame plate 84 and frictionally engages an annular knurled section 114 on hub member 64. A retainer ring 116 is entrapped in an annular groove 118 on shaft 62. Entrapped under compression between a surface of brake member 112 and retainer ring 116 is a helical index spring 122.

Stop-time gear 58 engages for rotation an idler gear 124 journalled for rotation between plates 50 and 84. Idler gear 124 engages for rotation a clutch gear 126 which is rotatable about a clutch shaft 128 journalled for rotation between plates 50 and 84. A retainer ring 130 is secured in an annular groove 132 in shaft and a helical compression spring 133 is entrapped between the retainer ring and clutch gear 126. A clutch surface 134 of gear 126 is in frictional engagement with a clutch surface 136 of a geneva drive gear 138. Referring now to FIGS. 3*b* and 4, gear 138 is staked to a knurl 140 on shaft 128 and includes an even number of gear teeth. The face widths of every other tooth are less than the face widths of the remaining teeth so that there is an even number wide teeth 142 and even number of narrow teeth 144 disposed in between the wide teeth.

Duration timing means 24 includes a timing cam member 146 rotatable about an axis substantially parallel to the rotational axis of stop-time shaft 62. A duration time shaft 148 is pressed into an aperture 150 in timing cam member 146. Shaft 148 is rotatably journalled in an aperture 152 in mechanism plate 50 and in a bushing 154 staked into frame plate 84. A duration time hand 156 is pressed onto and rotates with shaft 148. This hand indicates the duration of a timing cycle on a duration time dial 158. A knob 159 is pressed onto a distal end of shaft 90.

Timing cam member 146 includes a face 160 on which a plurality of cylindrically shaped drive projections 162 disposed equidistant from one another in a circular pattern. FIG. 7 shows the positioning of projections 162. In between each projection 162 is a notch 164. The teeth of geneva drive gear 138 engages projections 162 in a rotational driving manner. The wide teeth 142 are provided clearance during rotation by notches 164, and the narrow teeth 144 pass over face 160 of timing cam member 146. A portion of the periphery of timing cam member 146 comprises a portion of a cylindrical surface 161 against which teeth 142 can lock.

Timing cam member 146 further includes a peripheral cam profile 166 carried generally concentric with shaft 148.

Interconnecting duration timing means 24 and electrical switch 16 is a switch actuation means 168 which includes a slideable contact operating plate 170, a biasing spring 172, a control plate 174, and coil springs 176. Plates 170 and 174 are carried in juxtaposition by a shoulder 178 of bushing 154 and a retainer lug 180. Bushing 154 and lug 180 are staked to metallic frame plate 84, loosely entrapping plates 170 and 174 against frame plate 84. Contact operating plate 170 includes an integrally formed shoulder member 182 having an inclined surface 184. Rounded annular shoulder 110 on hub member 92 engages inclined surface 184 when shaft 62 moves axially in a direction of arrow 186 in FIG. 4. This ramps contact operating plate 170 in a direction indicated by arrow 240.

Biasing spring 172 includes a central convolution 190 located around a spring-retaining lug 192 that extends from and is formed integrally with control plate 174. One arm 194 extends through an opening in shoulder member 182. Another arm 198 extends through an opening 200 in a lug 202 which is struck from and is formed integrally with control plate 174. In order to reduce frictional engagement between plates 170 and 174, the latter has dimples 204 formed therein which permit only limited frictional contact engagement therebetween. Limited frictional contact engagement between contact operating plate 170 and the juxtaposed surface of metallic frame plate 84 is obtained through the provision in the later of an elongated boss 206 and dimples 208. Retainer lug 180 guides plates 170 and 174 for translatory movement relative to metallic frame plate 84.

As shown in FIGS. 3*b*, 4 and 6, a cam follower pin 210 extends through and is secured by staking to control plate 174. One end of pin 210 extends into an elongated slot 212 in contact operating plate 170 and another elongated slot 214 in frame plate 84. The other end extends to engage cam profile 166. The position of control plate 174 in relation to frame plate 84 depends upon the position of cam follower pin 210 with respect to cam profile 166. Coil springs 176 connected between plates 170 and 174 and frame plate 84 pull plates 170 and 174 in a direction indicated by arrow 216 in FIG. 6.

Duration time shaft 148 extends through both plates 170 and 174 as shown in FIG. 4. A slot 218 in the contact operating plate 170 is overlayed by a slot 220 in control plate 174, and shaft 148 extends therethrough.

Electrical switch 16 is shown in the illustrated embodiment as a switch module 222 having slideable actuator projections 224 and 226. These projections protrude through actuator slots 228 and 230, respectively, in operating plate 170 and also through clearance slots 232 and 234 in control plate 174. Ends 236 and 238 of slots 232 and 234 engage arms 224 and 226. Movement of projections 224 and 226 results in making and/or breaking of electrical contacts in switch 16. An example of the kind of switching function performed by switch 16 will be explained later.

In operation, motor driven timer 10 displays the time of day on hands 28, 30, and 32 against time markings 26. When stop timing means 20 and duration timing means 24 are not functioning together to produce a timed-switching function, the stop-time hand 54 remains stationary and the duration time hand rotates to indicate the same time on dial 56 as is indicated on time markings 26.

To set the function timing means 18, stop-time knob 63 on the end of stop-time shaft 62 is manually grasped and pushed in the direction of arrow 186 in FIG. 4. This action disengages leg 96 from aperture 98. In addition, rounded annular shoulder 110 on hub member 92 engages inclined surface 184 of shoulder member 182 and pushes contact operating plate 170 in a direction indicated by arrow 240 in FIG. 4. Projections 224 and 226 of switch 16 respond to this movement, making or breaking at least one set of contacts within the switch. While the shaft remains "pushed in" it is rotated in the direction of arrow 242 in FIGS. 5 and 7 whereupon floating pin 102 engages one of engagement steps 108 and urges hub member 92 and stop gear 58 in the direction of arrow 242. At the same time, leg 96 engages and drives drive dog 68 as shown in FIG. 7. As stop gear 58 is rotated, leg 96 and aperture 98 are separated angularly an amount desired and indicated by the relative location of stop-time hand 70, which is responsive to movement of dog 68, to the markings on stop-time dial 56. Hand 54 indicates the time that the timed function is to terminate. When gear 58 is manually rotated, it in turn, rotates idler 124 and clutch gear 126. Before the manual setting was initiated, geneva driver 138 remains stationary, being locked against cylindrical surface 161. After setting the desired stop-time, knob 63 is released, but shaft 62 is prevented in returning to the axial position it occupied prior to setting. Leg 96, no longer being aligned with aperture 98, stops against a face of gear 60 under the urging by spring 122 in a direction of arrow 244 in FIG. 4.

After the stop-time is set, the duration time is set by grasping knob 159 and rotating it clockwise as indicated by arrow 246 in FIG. 7. As timing cam member 146 is rotated, cylindrical surface 161 slides past the tips of wide teeth 142 until the first of projections 162 (indicated as 162' in FIG. 7) engages the narrow tooth 144 that is overlapping face 160 of member 146. At about the same time cam follower pin 210 is moved in the direction of arrow 262 in FIG. 6 by cam profile 166 to its farthest location away from shaft 148 as shown in FIG. 6. Switch 16 is responsive to this movement. Continued timing causes geneva driver 138 to rotate in the direction of arrow 250, carrying clutch gear 126 along with it through the frictional grip provided by spring 133 on clutch surfaces 134 and 136. Clutch gear 126, in turn, rotates gear 58 through idler 124 in a direction of arrow 252 in FIG. 7. This action angularly moves leg 96 back toward aperture 98, and effectively subtracts time away from the time set for the function to stop. Dog 68, and therefore stop-time hand 54, stays where leg 96 moved them when the stop-time was set. They do not move along back with leg 96. This keeps hand 54 pointing at the stop-time set on dial 56 right up until dog 68 is reengaged by leg 96 as will be explained later. The function timing is now set, and the timing sequence occurs as follows:

1. The output drive gear 52 on time-of-day indicating means 14 drives timing gear 60 in the direction of arrow 242 in FIG. 7. As timing gear 60 is rotated, stop-time gear 58 remains stationary. Drag brake member 112 maintains a snug grip on annular knurled section 114 thereby helping to keep gear 58 stationary in relation to gear 60.

2. Eventually, aperture 98 on gear 60 rotates to the position where it aligns with leg 96, whereupon the leg is abruptly urged into the aperture by the compressive force of spring 122.

3. The movement of leg 96 and therefore hub member 92, in the direction of arrow 244 separates shoulder 110 from inclined surface 184 of contact operating plate 170 allowing that member to move in the direction of arrow 254 in FIG. 4 under the influence of spring 172. This movement can be used to switch contacts in switch 16, for example, it can close at set of electrical contacts (not shown).

4. Immediately upon the movement of leg 96 into aperture 98, gear 58 starts to rotated along with gear 60 through the interlocking relationship of leg 96 in aperture 98.

5. Gear 58 drives clutch gear 126 through idler 124 in a direction indicated by arrow 256 in FIG. 7.

6. Through the frictional clutching engagement between surfaces 134 and 136, geneva driver 138 is also rotated without slipping by clutch gear 58.

7. Geneva driver 138 engages drive projections 162 on timing cam member 146 causing it to rotate in the direction of arrow 264 in FIG. 7.

8. As the rotation of member 146 continues, it reaches a point where follower pin 210 slides down a slope 258 of cam profile 166 under the influence of springs 176. This action kicks the cam angularly around until pin 210 rests in the lowest cam position 260 on member 166. Movement of pin 210 causes plate 174 to move in the direction of arrow 262 in FIG. 6 and causes electrical contacts in switch 16 to make or break.

9. At this point teeth 142 and 144 on geneva driver 138 are in the angular position shown in FIG. 7 where a wide tooth 142 engages surface 161 and stops the rotation of the driver. Clutch gear 126 continues to drive and slips past driver 138 through the clutching action of clutch surfaces 134 and 136. The duration time hand 156 has returned to "off" as indicated on dial 158. Leg 96 has re-engaged drive dog 68 and rotates it so that stop-time hand 54 remains in synchronization with hour hand 28. This completes the timing operation of function timing means 18.

One application of this timer is in a range to provide an automatic cooking feature. In this case, stop-time means 20 is used to set the time the oven is to start cooking, and duration timing means 24 is used to program the number of hours of cooking time desired. After setting the function timing means 18, the movement of shoulder 110 from inclined surface 184 causes contacts in switch 16 to make, providing power to the heating elements of the range. The falling of follower pin 210 down the slope of cam profile 116 causes the same contacts to open, shutting off, cooking power and thereby ending the automatic cooking feature.

What is claimed is:

1. An automatic timer comprising:

a. a housing;

b. a stop-time means, rotatably carried in said housing, for determining and indicating when a timing function is to be terminated, said stop-time means including a timing gear and a stop-time set shaft; and c. a duration timing means, rotatably carried in said housing, for determining and indicating the duration of a timing function, including;

i. a clutch gear, rotatably carried in said housing and coupled for rotation with said timing gear of said stop-timing means, ii. a geneva driver gear, rotatably carried in said housing and engaging said clutch gear, having an even number of gear teeth, the face width of every other tooth being less than the face width of the remaining teeth, and iii. a driver member pivotally journalled in said housing and engaging with said geneva driver gear.

2. The timer as recited in claim 1, further including an electrical switch and a switch actuation means, said switch actuation means engaging said duration timing means and said stop-time means for selectively actuating said electrical switch in response to pivoting of said driven member by said geneva drive gear or to manual movement of said stop-time means.

3. The timer as recited in claim 2 wherein said switch actuation means comprises a cam carried by said driver member said cam selectively actuating said electrical switch.

* * * * *